US009291087B2

(12) United States Patent
Geminn et al.

(10) Patent No.: US 9,291,087 B2
(45) Date of Patent: Mar. 22, 2016

(54) EXHAUST GAS SYSTEM

(75) Inventors: Markus Geminn, St. Martin (DE); Andreas Steigert, Lambrecht (DE); Thomas Weidner, Edenkoben (DE); Klaus Himmelstein, Jockgrim (DE)

(73) Assignee: TENNECO GMBH, Edenkoben (DE)

( * ) Notice: Subject to any disclaimer, the term of this patent is extended or adjusted under 35 U.S.C. 154(b) by 923 days.

(21) Appl. No.: 13/500,660

(22) PCT Filed: Oct. 6, 2010

(86) PCT No.: PCT/EP2010/064934

§ 371 (c)(1),
(2), (4) Date: Apr. 23, 2012

(87) PCT Pub. No.: WO2011/042471

PCT Pub. Date: Apr. 14, 2011

(65) Prior Publication Data

US 2012/0198825 A1 Aug. 9, 2012

(30) Foreign Application Priority Data

Oct. 6, 2009 (DE) ..... 10 2009 048 407

(51) Int. Cl.
*F01N 1/00* (2006.01)
*F01N 13/10* (2010.01)
*F01N 13/18* (2010.01)

(52) U.S. Cl.
CPC ..... *F01N 13/10* (2013.01); *F01N 13/1811* (2013.01)

(58) Field of Classification Search
CPC . F01N 13/10; F01N 13/1811; F01N 13/1805; Y10T 403/5793
USPC ..... 60/324
See application file for complete search history.

(56) References Cited

U.S. PATENT DOCUMENTS 3,504,709 A * 4/1970 Cassel ..... F01N 13/08 138/116
4,188,784 A 2/1980 Hall
4,289,169 A 9/1981 Banholzer
7,565,800 B2 7/2009 Williams et al.

(Continued)

FOREIGN PATENT DOCUMENTS

DE 10 2008 018 668 A1 11/2009
EP 1 793 101 A2 6/2007

(Continued)

*Primary Examiner* — Kenneth Bomberg
*Assistant Examiner* — Jason Sheppard
(74) *Attorney, Agent, or Firm* — Hudak, Shunk & Farine Co. LPA

(57) ABSTRACT

An exhaust gas system 1 for an internal combustion piston engine, having an exhaust manifold 2 having a plurality of manifold tubes Z1-Z4 and an exhaust gas fitting 2.1, and an exhaust gas line element 3 having an exhaust gas pipe fitting 3.1 that can be connected to the exhaust gas fitting 2.1 by the exhaust gas pipe fitting 3.1. The exhaust gas manifold 2 and at least the exhaust gas pipe fitting 3.1 of the exhaust gas line element 3 each have a partition 2.2, 3.2, each forming two separate exhaust gas channels A2*a*, A2*b*, A3*a*, A3*b* each having a flow axis S2, S3, and comprising an end face 2.2*s*, 3.2*s* running transverse to the flow axis S2 in the area of the fitting 2.1, 3.1, wherein the edge segment R1, the edge segment R2, and/or the core segment K of the exhaust manifold 2 at least partially contact the exhaust gas pipe fitting 3.1 in the axial direction when the internal combustion piston engine is in the warm state.

15 Claims, 5 Drawing Sheets

(56) References Cited

U.S. PATENT DOCUMENTS

| | | | | |
|---|---|---|---|---|
| 8,375,707 | B2 * | 2/2013 | Muller | 60/323 |
| 2002/0040579 | A1 | 4/2002 | Furudate | |
| 2009/0288405 | A1 * | 11/2009 | Shibasaki | 60/323 |
| 2010/0005793 | A1 * | 1/2010 | Sloss | F01N 13/08 60/324 |

FOREIGN PATENT DOCUMENTS

| | | | |
|---|---|---|---|
| JP | 09 210261 | A | 8/1997 |
| JP | 10 238341 | A | 9/1998 |
| JP | 2001 055920 | A | 2/2001 |
| WO | 86 03256 | A1 | 6/1986 |

* cited by examiner

EXHAUST GAS SYSTEM

FIELD OF THE INVENTION

The invention relates to an exhaust gas system for an internal combustion piston engine, comprising a multishell manifold with several cylinder connection pipes or manifold pipes Z1-Z4 and an exhaust gas outlet fitting or exhaust gas fitting, as well as an exhaust gas guide element with an exhaust gas pipe fitting made of cast iron, which can be connected or welded via the exhaust gas pipe fitting to the exhaust gas fitting, wherein the manifold and at least the exhaust gas pipe fitting of the exhaust gas guide element each have a partition wall, each of them forming two separate exhaust gas channels A2*a*, A2*b*, A3*a*, A3*b* each with a flow axis S2, S3, while the respective partition wall in the region of the fitting has an end face running at right angles or at least transversely to, the flow axis S2. The end face is preferably configured as a free end face. The exhaust gas turbine is configured as a twin-scroll turbocharger, so that group separation at the manifold end can be used in the turbocharger.

BACKGROUND OF THE INVENTION

From EP 1 793 101 A2 there is known a partitioned exhaust gas manifold for internal combustion engines, formed from three half-shells, the middle half-shell forming a partition plane or a partition plate. The exhaust manifold has four cylinder connection fittings and two partitioned exhaust gas channels connected thereto, as well as an exhaust gas pipe connection fitting partitioned by the partition plate, where the respective exhaust gas channel empties. The free end face of the partition plate, running at right angles to the flow axis, is level or flat in configuration.

From U.S. Pat. No. 4,289,169 A there is known an exhaust gas channel with a partition plate. The partition plate has two level wall surfaces, in each of which there is provided an oblong groove or recess. The region of this groove or recess serves as a predetermined breaking point in event of elevated pressure loads due to the different thermal expansion of exhaust gas channel and partition plate. The free end face of the partition plate, running at right angles to the flow axis S2, is level or flat in configuration.

From JP 2001-55920 A there is known a coupling piece between a partition wall of an exhaust manifold and a partition wall of an exhaust gas pipe. The coupling piece is curved or provided with an undercutting. This ensures flexibility for the main connection between the manifold and the exhaust gas pipe. Due to the limited width of the coupling piece, the tightness of this connection is not assured. The free end face, of the respective partition wall, running, at right angles to the flow axis, is level or flat in configuration.

SUMMARY OF THE INVENTION

The invention is based on the problem of configuring and arranging a partition wall so that an increased endurance strength of the partition wall and good tightness of the connection is assured.

This problem is solved according to the invention in that the end face of the manifold or at least an edge segment R1, an edge segment R2 and/or a core segment K of the end face at least partially contact the exhaust gas pipe fitting in the axial direction of the flow axis S2, S3 or the geometrical axis G, at least when the internal combustion piston engine is in the warm state, i.e., in operation. The contact ensures an increased tightness of this connector at least in the warm state, i.e., in the range of operating temperatures.

The exhaust gas fitting is preferably three-piece and in addition to the partition wall, which can be configured as a partition plate, it has a first and a second shell, which are joined to the partition wall.

The exhaust gas outlet fitting or exhaust gas fitting and the exhaust gas pipe fitting of the exhaust gas guide element generally have the same diameter.

The problem is also solved by a system consisting of a triple or multiple-shell exhaust manifold and an exhaust gas guide element coupled or welded on to it, configured as a twin-scroll turbocharger or a twin-scroll exhaust gas turbine, preferably made of cast iron, wherein in the exhaust manifold and at least in the exhaust gas pipe fitting of the exhaust gas turbine the exhaust gas channels A2*a*, A3*a* are separated against gas exchange from the exhaust gas channels A2*b*, A3*b* by the partition walls joined by means of the groove down to a leakage rate on the order of at most 0.05 to 1 mm or 0.1 mm to 0.3 mm. This prevents or at least substantially diminishes harmful leakage or a cross-talk between the exhaust gas channels and the associated loss of power and torque due to lack of vacuum. The exhaust gas turbine, as already mentioned, is configured as a twin-scroll turbocharger.

Furthermore, it can be advantageous for the core segment K to make contact with the partition wall and/or for the particular edge segment R1, R2 to make contact with a bearing surface of the pipe fitting. The partition wall, as indicated above, preferably has a groove with a groove base serving as a bearing surface in the axial direction. Moreover, a bearing surface is provided at the turbocharger end, which is flush with the respective edge segment R1, R2 in the axial direction.

For this, it can also be advantageous for an end face to have a curved or corrugated profile running in the direction of the flow axis S2, S3 or a geometrical axis G with one to ten or more recesses A1, A2, or at least to be profiled in configuration. Thanks to this shape of the profile, compressive stresses occurring especially in the radial direction in the partition wall in the region of the end face are readily dissipated and limited in their magnitude. Owing to exhaust gas being present on both sides, the partition wall is considerably hotter than the exhaust gas pipe or the exhaust gas fitting. Due to the profiled configuration, an improved absorption of thermal stresses or a reduction of thermal stress occurrence is assured. This increases the endurance strength of the connection.

Moreover, it can be advantageous for the recesses A1, A2 to have an arc, semicircle, or groove shape, and/or for the recesses A1, A2 to have a width bA that varies in relation to the direction of the flow axis S2, S3 and/or for the recess A1 or A2 to have an undercut H relative to the flow axis S2, S3. The undercut H can be provided alternatively or additionally with regard to both directions, i.e., in the flow direction, and opposite to the flow direction. As an alternative to a recess forming a cavity, one can also provide appropriate molded-on pieces that ultimately ensure the formation of a cavity.

It can also be advantageous for the edge segments R1, R2 of the partition wall to lie on the outside in the radial direction in the area of the end face, and for the core segment K to be bounded by the edge segments R1, R2, while the recess A1, A2 is provided between the core segment K and the respective edge segment R1, R2. Thus, the recess A1, A2 is confined to the area between the edge segments R1, R2. This area, owing to the flow relations, is subject to an especially large heat load. The respective edge segment R1, R2 can be configured as a journal, which sticks out or is set back relative to the core segment K in the direction of the flow axis S2, S3. The edge segment R1, R2 lies tight against the end face of the fitting being connected.

It can advantageously be provided that the end face has the recess A1, A2 in the transitional region from the core segment K to the particular edge segment R1, R2 and/or the transitional region has a radius r. In particular, the transitional region to the edge segment R1, R2 is subject to a very high mechanical load, because it is joined or welded to the fitting. This limits its heat-related expansion. The recesses or radii placed according to the invention ensure the necessary dissipation of stresses.

It can be of special importance for the present invention if the edge segments R1, R2 have a spacing aR and the spacing aR corresponds to an internal diameter di2 of the exhaust gas fitting. The width bK of the core segment K is thus limited to the internal diameter di2 of the exhaust gas pipe fitting or to the length 13 of the groove of the exhaust gas fitting described hereafter.

In connection with the configuration and arrangement of the invention, it can be advantageous for the end face of the preferably cast-iron partition wall of the manifold or the exhaust gas pipe fitting to have a groove serving as connection element, of length 13, with a groove base into which the other end face of the exhaust gas pipe fitting or the partition wall of the manifold can be inserted to join the partition walls, wherein the length 13 corresponds to an internal diameter di3 of the exhaust gas pipe fitting. With the configuring of a groove, on the one hand an optimal connection is assured between the partition walls. On the other hand, the profiled configuration of the end face can be assured, despite the resulting formation of slots or gap between the end faces being sealed, because these are covered or sealed by the groove or its walls.

For this, it can be advantageous for the partition wall to have a width b2 between 1 mm and 7 mm, at least in the area of the groove. The partition wall is part of the preferably cast-iron exhaust gas pipe fitting and thus is also made of cast iron. A minimum thickness between 1 mm and 3 mm is favorable, since it can, still be fashioned as a cast iron part. The maximum thickness of 5 mm to 7 mm ensures a savings on material and weight, in light of the toughness.

Moreover, it can be advantageous for the exhaust gas pipe fitting to have a housing wall with an inner circumference Ui3 and in one end face of the housing wall an indentation with a width b3 is provided, forming a bearing surface and extending in the direction of the flow axis S2, S3 across the inner circumference Ui3. The indentation or the axially offset bearing surface extending over a partial radius of the original end face produces an end surface with reduced width. Thus, the indentation produces a profiled end face of the exhaust gas pipe fitting with an end surface and an adjacent bearing surface at the end face. Since the particular edge segment R1, R2 has a width bR, which corresponds to the width b3 of the shoulder, and the two edge segments have the spacing aR, which corresponds to the width bK of the core segment or the length 13 of the groove, a centering is assured between the fittings being joined. Thus, the diameter of the shoulder corresponds to the outer spacing of the two edge segments R1, R2, and thus their position is determined in the radial direction. Accordingly, the two edge segments R1, R2 stand at the end-face bearing surface or are axially flush with it. Moreover, the shoulder or the end-face bearing surface via the rest of the partial circumference serves to receive or support the two shells of the exhaust gas fitting, whose position in the radial direction is determined by the shoulder. Finally, the place at which the exhaust gas fitting plunges into the shoulder or the exhaust gas pipe fitting is optimal for the welding of the two fittings.

Moreover, it can be advantageous to provide the groove base in relation to the flow axis S2, S3 at least partly at the height of the end surface or the bearing surface. This makes possible a simplified configuring of the groove. A milling cutter can be used to plunge into and be retracted from the material in the radial direction.

Furthermore, it can be advantageous for the particular edge segment R1, R2 and/or the partition wall and/or the particular half shell of the exhaust gas fitting to bear tightly against the bearing surface of the exhaust gas pipe fitting in the cold state at the end face inside the indentation of the exhaust gas pipe fitting in the direction of the flow axis S2, S3. Leakiness or local gaps of at most 0.05 to 1 mm or 0.1 mm to 0.3 mm are permissible in regard to the equal pressure and pulse charging here. A crosstalk between the exhaust channels is thus prevented, or at least considerably and adequately reduced.

Moreover, it can be advantageous for the partition wall to be fashioned at least in the area in front of the groove thicker than a width b of the groove, while the partition wall in the area of the end surface has a flattening with a thickness d, and the thickness d is either equal to the width b of the groove or smaller than the width b of the groove. Thus, the partition wall can be configured more thick for the greater portion of its length, which enhances the stability and the service life. An improved flow behavior is observed thanks to the configuring of the flattening and, thus, the concomitant change in the flow cross sections.

It can be advantageous for the flattening to have a height hA in the direction of the flow axis S2, S3, while the partition wall is inserted into the groove by 5% to 70%, by 10% to 50% or by 30% of the height hA. In the area where the flattening sticks out from the groove there necessarily occurs a local broadening of the flow cross section. This is accompanied by a local decrease in the dynamic pressure in the particular exhaust gas channel, immediately in the area of the sealing site for the adjoining channel. This has a positive impact on the leakage which can occur even despite the small gap.

Finally, it can be advantageous for the groove base to be configured flat or profiled and/or for its profiling to match the profile of the end surface, while in regard to the flow axis there is provided a radial spacing a between the groove base and the end surface of at least 0.1 mm to 0.3 mm. The thermally produced expansion of the partition wall of the exhaust gas fitting also occurs in the radial direction relative to the partition wall or the groove base of the exhaust gas pipe fitting. Therefore, the profiling of the respective partition wall should be such that the mentioned spacing a is preserved in every operating state, i.e., from ambient temperature up to around 1100° C., in order to prevent a warping.

The profile of the groove base can also be mirror-symmetrical to that of the partition wall in relation to the line of bearing. This would prevent a collision in the radial direction.

For this, it can also be advantageous to separate the exhaust gas channels A2*a*, A3*a* from the exhaust gas channels A2*b*, A3*b* in terms of gas exchange by having the partition walls bearing by means of the groove and the indentation down to a leakiness or gap on the order of at most 0.05 to 1 mm or 0.1 mm to 0.3 mm. Thus, cross talk between the exhaust channels is prevented or at least substantially decreased.

In addition, it can be advantageous for the core segment K in the cold state to have a spacing aK from the groove base, the spacing aK being between 5% and 50%, between 25% and 35% or 30% of the depth tN of the groove. However, to ensure the tightness of the tongue and groove joint, a relative small spacing aK is desirable. The part of the partition wall located in the groove is isolated from the exhaust gas, so that the input of heat comes only from thermal conduction and not convection. Since the partition wall is fired on both sides, one can assume a greater heating than that of the pipe wall. The greater heating also entails increased axial expansion. Therefore, the spacing aK existing in the cold state would be reduced or closed up after the heating, so that an optimal tightness is assured.

If the end surface of the partition wall of the manifold already in the cold state bears at least partly against the partition wall of the exhaust gas pipe fitting, the increased thermal expansion results in a pressure load on the partition wall. If the pressure load increases, the partition wall is squashed, which can ultimately also lead to a buckling or bending, so that the partition wall comes to bear against the two sides of the groove inside the groove. In this case, the tightness of the tongue and groove joint is increased.

By varying the gap or bearing situation between the end surface of the partition wall of the manifold and the groove base, one can thus influence the bearing situation between the partition wall and the side of the groove, and thus produce a crease X.

BRIEF DESCRIPTION OF THE DRAWINGS

Other benefits and details of the invention are discussed in the patent claims and the specification and presented in the figures. These show:

FIG. 6 with profiled groove base.

DETAILED DESCRIPTION OF THE INVENTION

Figure 1:
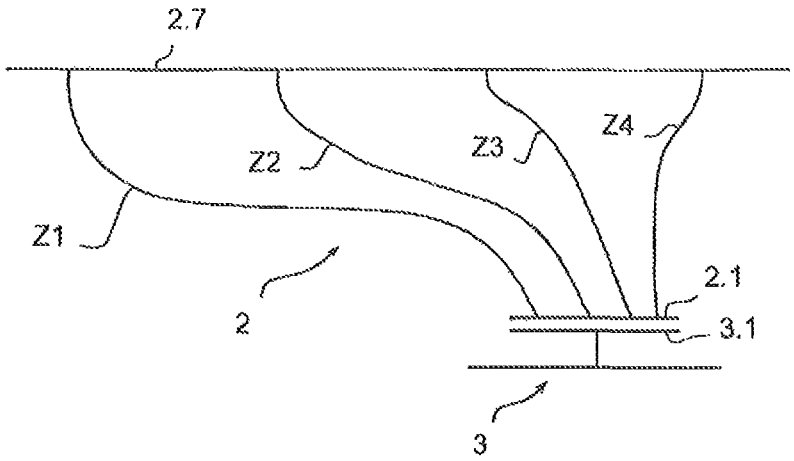
FIG. 1, an idealized representation of the manifold with adjoining exhaust gas turbocharger housing.

An exhaust gas system 1 shown in FIG. 1 has a manifold 2 as well as an adjoining exhaust gas guide element 3, configured as an exhaust gas turbocharger housing. The manifold 2 has four cylinder connection pipes Z1-Z4 or manifold pipes Z1-Z4, which are joined to a flange plate 2.7 at the engine side. At an opposite end, the manifold pipes Z1-Z4 form a common exhaust gas fitting 2.1.

The exhaust gas turbocharger housing 3 has an exhaust gas pipe fitting 3.1, by which the exhaust gas turbocharger housing 3 is joined to the exhaust gas fitting 2.1 of the manifold 2.

Figure 2:
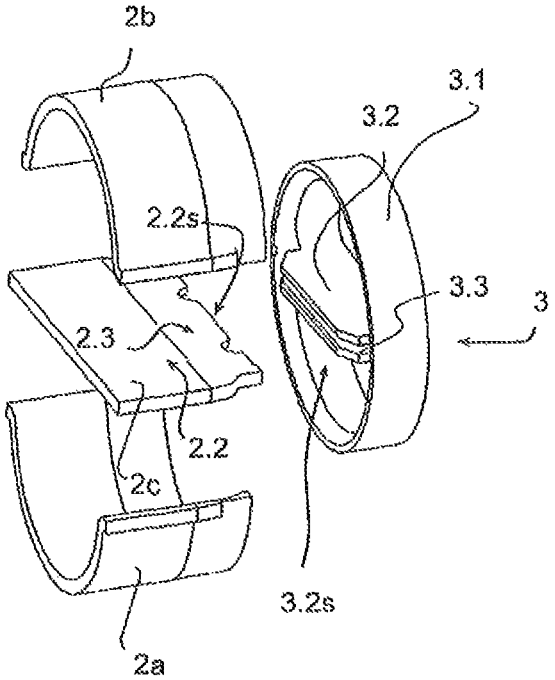
FIG. 2, the manifold in exploded view, as well as the adjoining exhaust gas turbocharger housing.

The manifold 2 according to the exploded view of FIG. 2 is made up of three shells 2*a*, 2*b*, 2*c*, the shell 2*c* being received at least partly in sandwich fashion between the top shell 2*a* and the bottom shell 2*b*. The third shell 2*c*, forming a partition plane between the two shells 2*a*, 2*b*, is fashioned as a partition wall 2.2 at their end near the turbocharger housing. The exhaust gas turbocharger housing 3 also has a partition wall 3.2 in the region of the exhaust gas pipe fitting 3.1. In the installed state per FIG. 1, the partition wall 2.2 tightly adjoins the partition wall 3.2, the two partition walls 2.2, 3.2 being coupled by a tongue and groove joint. For this, a groove 3.3 is provided inside an end surface 3.2*s* of the partition wall 3.2, into which the partition wall 2.2 can be inserted by its end surface 2.2*s*. For this, the partition wall 2.2 has a flattening 3.2 at its end face side, so that the thickness of the partition wall 2.2 corresponds to a width b of the groove 3.3.

Figure 3A:
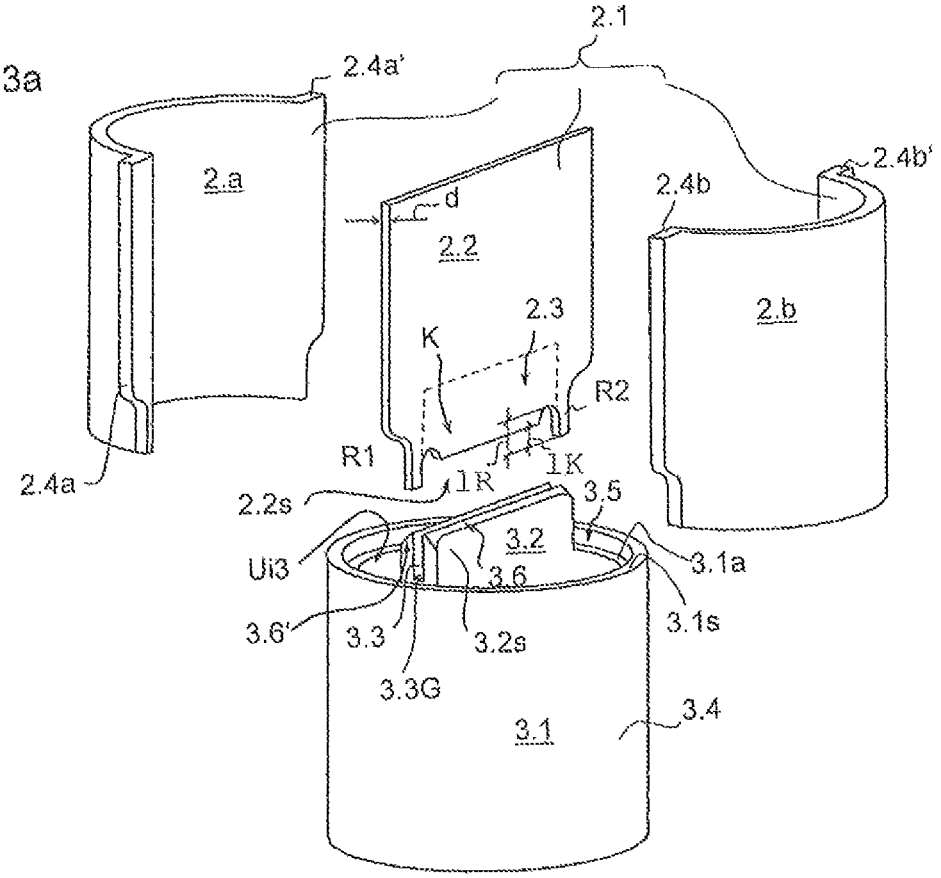
FIG. 3*a*, the exhaust gas and exhaust gas pipe fitting as an exploded drawing, as well as the adjoining exhaust gas pipe fitting.

FIG. 3*a* shows the exhaust gas fitting 2.1 and the exhaust gas pipe fitting 3.1 in detail, while an exploded drawing shows the three-shell makeup of the exhaust gas fitting 2.1.

The exhaust gas pipe fitting 3.1 is a single piece and has, besides a cylindrical housing wall 3.4, a partition wall 3.2. The partition wall 3.2 projects in the axial direction beyond the end of the housing wall 3.4 at the end face and has a centrally located groove 3.3. The groove 3.3 forms, at the end face, two not further designated partial walls of the partition wall 3.2, each of which is provided with a bevel 3.6, 3.6' at the end face. The housing wall 3.4 has an indentation 3.5 or corresponding shoulder across, its inner circumference Ui3. The shoulder 3.5 serves to take up the end of the first shell 2*a* and the second shell 2*b*, as is seen in the sectional view of FIG. 4*a*.

The groove 3.3 serves to take up the end of the partition wall 2.2 at the end face. The partition wall 2.2 has two edge segments R1, R2 fashioned as journals, which can be brought to bear inside the indentation 3.5 of the housing wall 3.4 per FIG. 4*b*. The two edge segments R1, R2 delimit a core segment K of the partition wall 2.2 with width bK, which can be placed inside the groove 3.3 per FIG. 4*b*. The respective edge segment R1, R2 has a length 1R. In the event that the partition wall 2.2 has a thickness d that is greater than the width b of the groove 3.3, a flattening 2.3 of the partition wall 2.2 is provided at least in the region of the core segment K, so that this can be introduced into the groove 3.3, per FIG. 4*a*, left side.

Figure 4A:
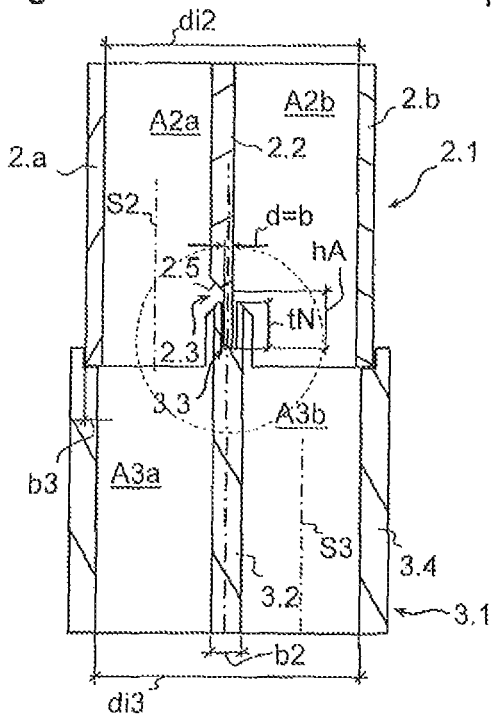
FIG. 4*a*, a cross sectional view of the installed fitting.
Figure 4B:
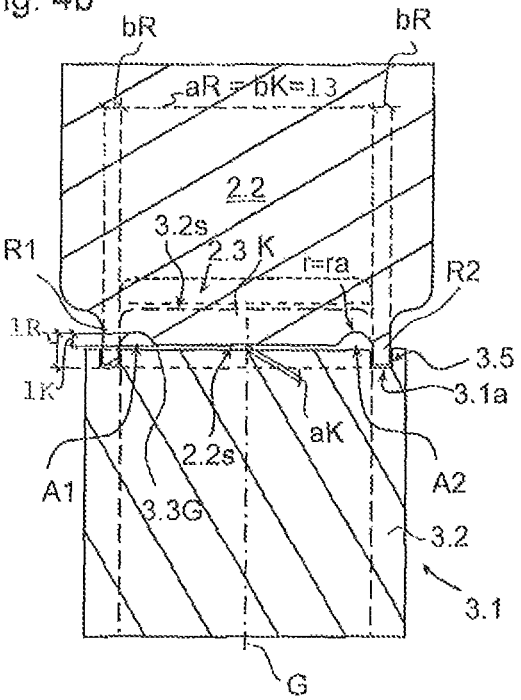
FIG. 4*b*, a cross sectional view per FIG. 4*a*, rotated 90°.

Between the respective edge segment R1, R2 and the core segment K there is provided an arc-shaped transition with radius r per FIG. 4*b*. The remaining core segment K projects in relation to this arc-shaped transition by around r/2 in the axial direction, so that a length 1K of the core segment K is smaller than the length 1R per FIG. 3*a* by approximately 40%.

Figure 7A:
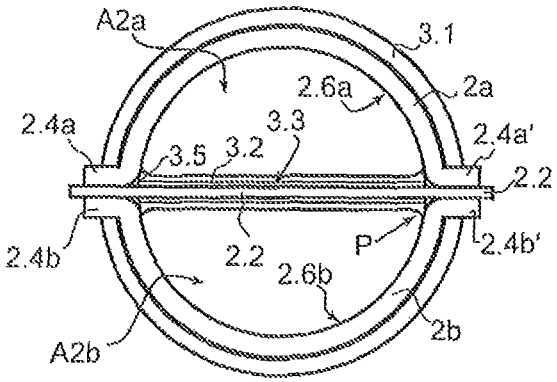
FIG. 7*a*, a perspective view of the installed fitting per FIG. 3*a* and FIG. 4 *a/b* in top view.

The connection between the two shells 2*a*, 2*b* and the partition wall 2.2 of shell 2*c* occurs by the angled edge parts 2.4*a*-2.4*b*', the shells 2*a*, 2*b* and the respective edge region of the partition wall 2.2, as shown in the top view of FIG. 7*a*.

The groove 3.3 has a groove base 3.3G, which stands out in the axial direction relative to a bearing surface 3.1*a* or the indentation 3.5 and is arranged-according to FIG. 4*a*, 4*b* at the height of an end surface 3.1*s*. The offset between the groove base 3.3G and the end surface 3.1*s* is somewhat smaller than the difference between the length 1R and the length 1K, so that at least in the cold state a spacing aK is produced between the core segment K or the end surface 2.2*s* and the groove base 3.3G per FIG. 4*b*.

In the representation of FIG. 4*a*, the partition wall 2.2 with flattening 2.3 (left side) and the partition wall 2.2 without flattening 2.3 (right side) are shown opposite each other. When a flattening 2.3 is necessary (left side), the cross section is locally widened in the region of the part of the flattening 2.3 that projects beyond the groove 3.3, relative to a flow axis S2, which brings about a drop in the dynamic pressure in this region. In the situation without flattening 2.3 (right side), a narrowing of the cross section occurs immediately in the region of the end of the partition wall 3.2 at the end face, in relation to a flow axis S3, due to the increased density of the partition wall 3.2 that still remains in the further course of the exhaust gas turbocharger housing 3, causing an increase in the dynamic, pressure. This pressure increase requires a greater tightness of the tongue and groove joint formed between the two partition walls 2.2, 3.2 for the purpose of reducing the crosstalk of the resulting exhaust gas channels A2*a*, A3*i* and A2*b*, A3*b*.

The groove 3.3 has a depth tN that, per the configuration of FIG. 4*a*, left side, is smaller than a height hA of the flattening 2.3. In corresponding manner, a bevel 2.5 is also provided between the flattening 2.3 and the other part of the partition wall 2.2.

As can be seen in the sectional view of FIG. 4*a*, the exhaust gas fitting 2.1 sits at the end face inside the indentation 3.5 of the housing wall 3.4. One inner diameter di2 of the exhaust gas fitting 2.1 is slightly smaller than an inner diameter di3 of the housing wall 3.4 of the exhaust gas pipe fitting 3.1. The exhaust gas fitting 2.1 is centered in the radial direction by the indentation 3.5 at the end face. One width b3 of the indentation 3.5 is smaller than the wall thickness of the exhaust gas fitting 2.1, which justifies the difference between the two inner diameters di2, di3.

Per FIG. 4*b*, the partition wall 2.2 is likewise centered by the two edge segments R1, R2 inside the indentation 3.5, despite the firm connection to the two shells 2*a*, 2*b*. The respective edge segment R1, R2 has a width bR that corresponds to the width b3 of the indentation 3.5 in the area of the partition wall 3.2, so that the respective edge segment R1, R2 on the one hand can bear against the housing wall 3.4 outwardly in the radial direction in the area of the indentation 3.5 and on the other hand it can bear or it bears against the partition wall 3.2 inwardly in the radial direction in order to ensure the necessary tightness of the resulting tongue and groove joint of the partition walls 2.2, 3.2.

Figure 3B:
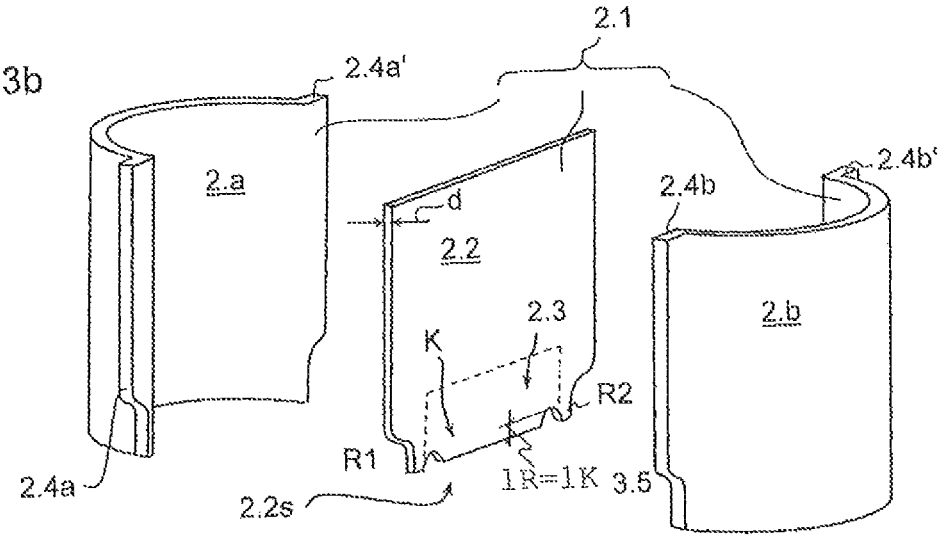
FIG. 3*b*, the exhaust gas fitting as exploded drawing per FIG. 3*a* with shortened edge segments.
Figure 4C:
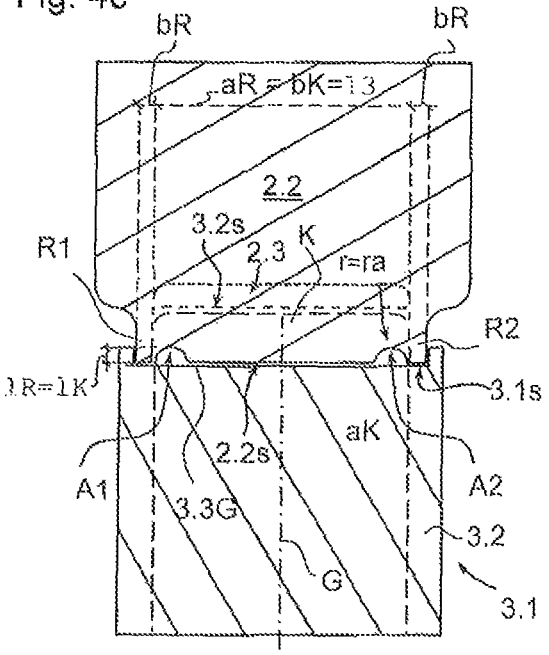
FIG. 4*c*, a cross sectional view per FIG. 4*b* of the sample embodiment of FIG. 3*b;*

The representation of FIG. 4*c* is geared to the sample embodiment of FIG. 3*b*. Once again there exists an arc-shaped transition with radius r per FIG. 4*c* between the respective edge segment R1, R2 and the core segment K. The remaining core segment K, however, does not project in axial direction, so that the length 1K of the core segment K roughly corresponds to the length 1R.

Figure 4D:
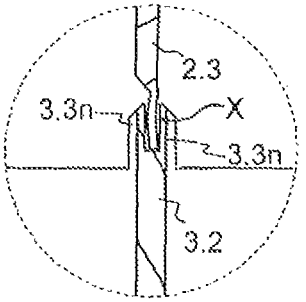
FIG. 4*d*, a detail view from FIG. 4*a;*

Per FIG. 4*b*, in the cold state a spacing aK is provided between the partition wall 2.2 or the core segment K and the partition wall 3.2. The spacing aK decreases with increasing temperature, since the respective partition wall 2.2, 3.2, becomes hotter than the exhaust gas pipe or the pipe fitting 2.1, 3.1. Depending on the choice of the spacing aK, a bearing is formed between the partition wall 2.2 and the partition wall 3.2, so that after further heating the narrower part of the partition wall 2.2 buckles or exhibits a crease X according to the detail view of FIG. 4*d*. In this case, the partition wall 2.2 will come to bear against at least one of the groove sides 3.3*n* inside the groove 3.3. This bearing establishes an enhanced tightness of the tongue and groove joint.

It should be noted in this context that, according to the representation of FIG. 7*a*, arrow P, the partition wall 3.2 can be brought to bear against an inner side 2.6*a*, 2.6*b* of the respective half shell 2*a*, 2*b* in the region of the radially outwardly situated side.

Figure 5:
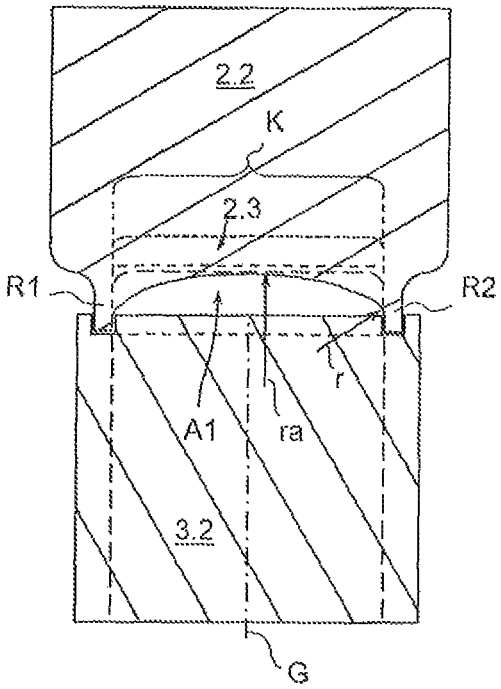
FIG. 5, a cross sectional view per FIG. 4*b* with alternative recess.

Alternatively to two recesses A1, A2 as represented by the sample embodiment of FIG. 4*b* inside the core segment K of the partition wall 2.2, one common recess A1 is also provided according to the sample embodiment of FIG. 5, having the radius r in the transitional region to the respective edge segment R1, R2. The recess A1 itself has the considerably larger radius ra.

Figure 6:
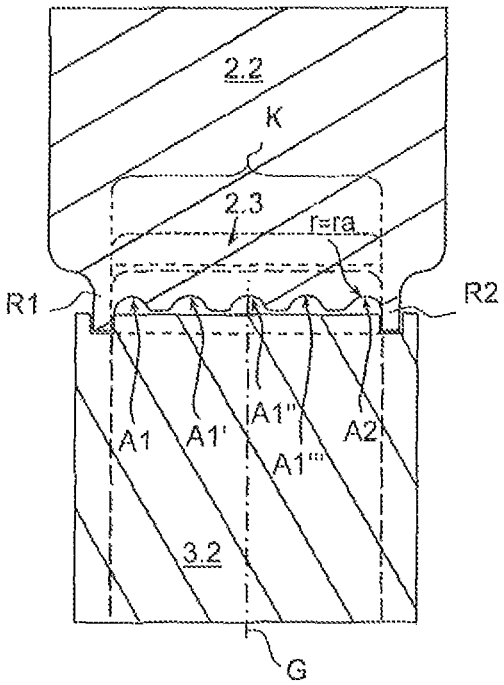
FIG. 6, a cross sectional view per FIG. 5 with alternative recess.

According to the sample embodiment of FIG. 6, and starting from the embodiment of FIG. 4*b*, three additional recesses are provided A1'-A'''', while all five recesses A1'-A1'''', A2 have the same cross sectional form, i.e., the same radius ra.

As already explained, it can be clearly seen in the top view of sample embodiment FIG. 7*a* that the exhaust gas fitting 2.1, formed by the two shells 2*a*, 2*b*, and the partition wall 2.2 are centered inside the indentation 3.5 of the exhaust gas pipe fitting 3.1, while the partition wall 2.2 is arranged inside the groove 3.3 of the partition wall 3.2. The partition wall 3.2, in turn, lies in the region of the radial side at four spots (see arrow P) against the inner side 2.6*a*, 2.6*b* of the respective shell 2*a*, 2*b*, except for a slight gap dimension in the range of at most 0.05 to 1 mm or 0.1 mm to 0.3 mm.

In order to guarantee the required tightness, furthermore, the bearing of the two shells 2*a*, 2*b* and/or the partition wall 2.2 inside the indentation 3.5 at the end face is necessary at least in part. As can be seen from FIG. 4*a*, 4*b*, both the end surface 2.2*s*, 3.2*s* of the respective half shell 2*a*, 2*b* and the end surface of the respective edge segment R1, R2 of the partition wall 2.2 lies tightly in the axial direction against the housing wall 3.4 or the partition wall 3.2 as integrated parts of the exhaust gas pipe fitting 3.1. The aforementioned gap dimensions also apply for these sealing sites.

Figure 7B:
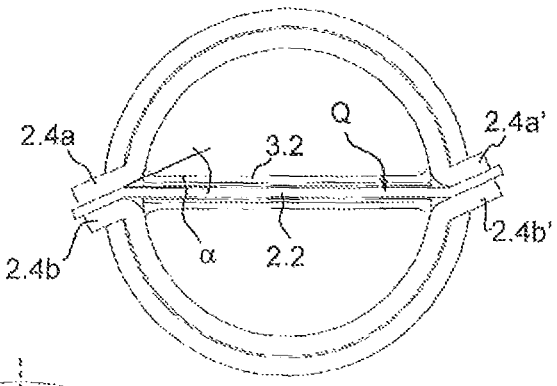
FIG. 7*b*, a view per FIG. 7*a* with altered cross section.

In the sample embodiment of FIG. 7*b*, the partition wall 2.2 is buckled in the region of the edge parts 2.4*a*-2.4*b*', so that the edge parts 2.4*a*-2.4*b*' and also the edge segments of the partition wall 2.2 are positioned at an angle of around 30° relative to the partition wall 2.2. Thus, a Z-shaped cross section Q results for the partition wall 2.2.

Figure 7C:
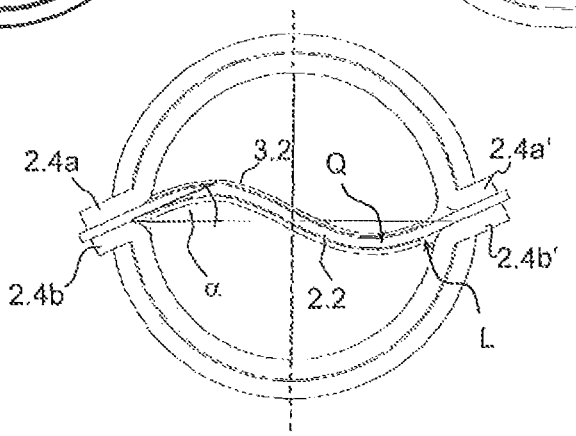
FIG. 7*c*, a view per FIG. 7*a*, 7*b* with altered cross section.

According to FIG. 7*c*, the angle position of the edge parts 2.4*a*-2.4*b*' is configured the same as in FIG. 7*b*, the partition wall 2.2 having an S-shaped cross section Q. The groove 3.3 present in the partition wall 3.2 likes runs in an S shape. It reaches either as far as the half shell 2*a*, 2*b* (left side of the picture) or is provided with a spacing from the half shell 2*a*, 2*b* (right half of the picture), while in a groove gap L so formed the partition wall 2.2 can sit on the partition wall 3.2 without lateral guidance by the groove 3.3 or the side of the groove 3.3*n*.

Figure 8:
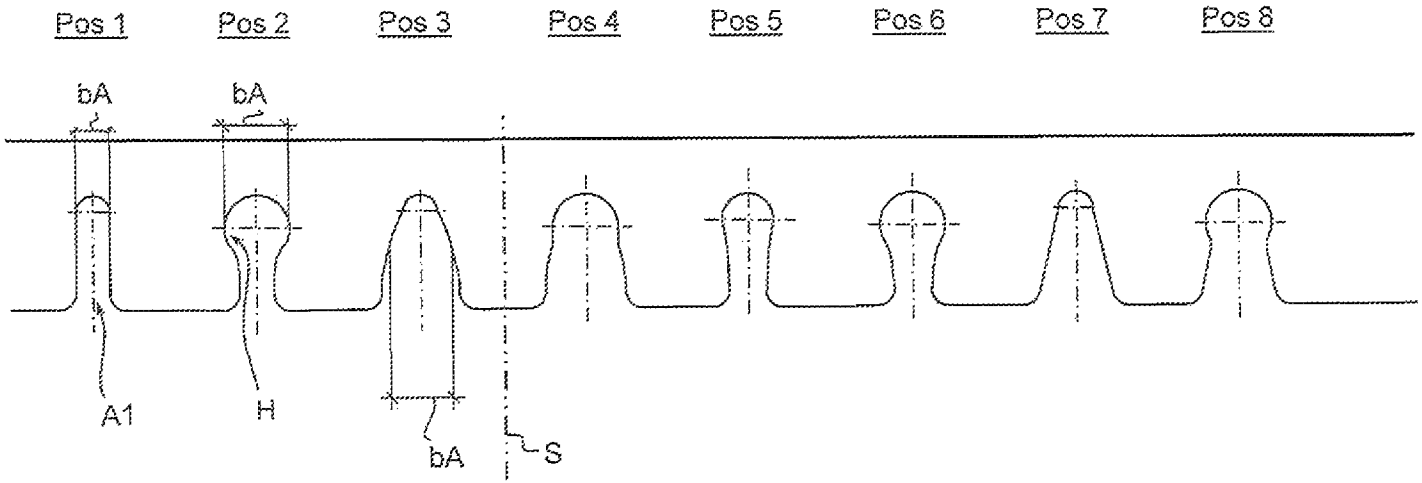
FIG. 8, different examples of the configuration of the recesses.

According to the sample embodiment of FIG. 8', the most diverse shapes with different widths bA can be provided for the respective recess A1. Alternatively to the circular or semi-circular shape from the sample embodiments of FIGS. 4*a*, 4*b*, 5 and 6, shapes with an undercut H as in FIG. 8 at positions 2, 5, 6 and 8 are also provided. The recess A1 of position 1 has a uniform width bA, while the recesses of positions 3, 4 and 7 have a width bA, which continuously becomes larger in relation to the flow axis S2, S3. The recesses A1 with undercut H per positions 2, 5, 6 and 8 accordingly have a narrowing of the width bA in relation to the flow axis S2, S3, i.e., a tapering.

Figure 9:
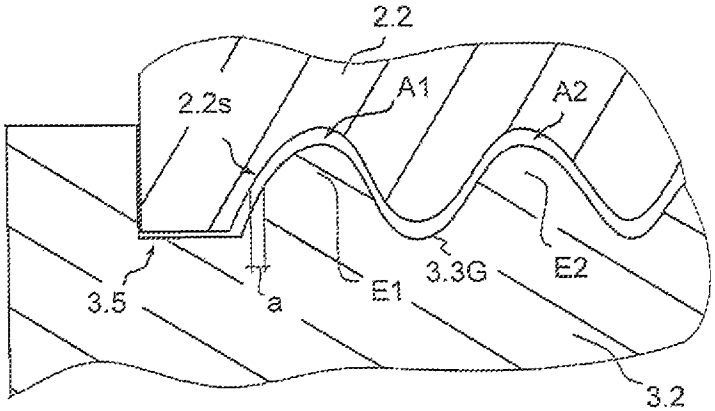
FIG. 9, a detail view per.

According to the sample embodiment of FIG. 9, the groove base 3.3G likewise has a profiling that corresponds to the profiling of the end surface 2.2*s* of the partition wall 2.2. In the areas where the partition wall 2.2 has the respective recess A1, A2, a corresponding elevation E1, E2 is provided at the groove base 3.3G. The recesses A1, A2 and the respective elevations E1, E2, are configured such that a minimum spacing a of 0.1 mm in the radial direction is guaranteed in every operating state of the exhaust gas system 1, so that the deformations and relative movements caused by thermal stress are assured, especially in the radial direction.

LIST OF REFERENCE NUMBERS

1 exhaust gas system
2 manifold
2*a* first shell, half-shell
2*b* second shell, half-shell
2*c* third shell
2.1 exhaust gas fitting, exhaust gas outlet fitting
2.2 partition wall, partition plate
2.2*s* end face
2.3 flattening
2.4*a* edge parts
2.4*a*' edge parts
2.4*b* edge parts
2.4*b*' edge parts
2.5 bevel
2.6*a* inner side
2.6*b* inner side
2.7 bevel
3 exhaust gas guide element
3.1 exhaust gas pipe fitting, fitting
3.1*a* bearing surface at end face
3.1*s* end face of pipe fitting
3.2 separating wall, partition wall
3.2*s* end face
3.3 groove
3.3G base of groove
3.3*n* side of groove
3A housing wall
3.5 indentation, shoulder
3.6 bevel
3.6' bevel
α angle
a spacing
A1 recess
A2 recess
A2*a* exhaust gas channel
A2*b* exhaust gas channel
A3*a* exhaust gas channel
A3*b* exhaust gas channel
aK spacing between K & 3.3G
aR spacing between R1 & R2
b width of 3.3
bA width of A1, A2
b width of K
bR width of R1 & R2
b2 width of 3.2
b3 width of 3.5
d thickness of 2.2 at 2.3
di2 inner diameter of 2.1
di3 inner diameter of 3.1
EI elevation
E2 elevation
G geometrical axis
hA height of flattening
H undercut of A1, A2
K core segment
L gap
1K length of K
1R length of R1 & R2
length of 3.3
P arrow (bearing of 3.2 against 2*a*, 2*b*)
Q cross section
r radius of transition between R1, R2 & K
ra radius of A1, A2
R1 edge segment, journal
R2 edge segment, journal
S2 flow axis
S3 flow axis
tN depth of 3.3
Ui3 inner circumference of 3.4
ZI cylinder connection pipe, manifold pipe
Z2 cylinder connection pipe, manifold pipe
Z3 cylinder connection pipe, manifold pipe
Z4 cylinder connection pipe, manifold pipe

What is claimed is:

1. An exhaust gas system (1) for an internal combustion piston engine, comprising:

a manifold (2) with several manifold pipes (Z1-Z4) and an exhaust gas fitting (2.1), as well as an exhaust gas guide element (3) with an exhaust gas pipe fitting (3.1), which can be connected via the exhaust gas pipe fitting (3.1) to the exhaust gas fitting (2.1), wherein i) the manifold (2) and ii) at least the exhaust gas pipe fitting (3.1) of the exhaust gas guide element (3) each have a partition wall (2.2, 3.2), the partition walls (2.2, 3.2) forming two separate exhaust gas channels (A2*a*, A2*b*, A3*a*, A3*b*) each with a flow axis (S2, S3), and the exhaust gas fitting (2.1) having an end face (2.2*s*) running transverse to the flow axis (S2), the exhaust gas pipe fitting (3.1) having an end face (3.2*s*) running transversely to the flow axis (S2), wherein the exhaust gas fitting end face (2.2*s*) of the manifold (2) or at least a first edge segment (R1), a second edge segment (R2) and/or a core segment (K) of the exhaust gas fitting end face (2.2*s*) at least partially contact the exhaust gas pipe fitting (3.1) in the axial direction at least when the internal combustion piston engine is in a warm state, and wherein the end face (3.2*s*) of the exhaust gas pipe fitting (3.1) has a groove (3.3) serving as connection element, of a length (13), with a groove base (3.3G) into which the exhaust gas fitting end face (2.2*s*) of the partition wall (2.2) of the manifold (2) can be inserted to join the partition walls (2.2, 3.2), wherein the length (13) corresponds to an internal diameter (di3) of the exhaust gas pipe fitting (3.1).

2. The exhaust gas system (1) according to claim 1, wherein the core segment (K) makes contact with the partition wall (3.2) and/or the first and/or second edge segment (R1, R2) makes contact with a bearing surface (3.1*a*) of the end face of the pipe fitting (3.1).

3. The exhaust gas system (1) according to claim 1, wherein the end face (2.2*s*, 3.2*s*) has a curved or corrugated profile running in the direction of the flow axis (S2, S3) or a geometrical axis (G) with one to ten or more recesses (A1, A2), or at least is profiled in configuration.

4. The exhaust gas system (1) according to claim 1, wherein the first and second edge segments (R1, R2) of the partition wall (22) lie on the outside in the radial direction in the area of the end face (2.2*s*), and the core segment K is bounded by the first and second edge segments (R1, R2), while the at least one recess (A1, A2) is provided between the core segment (K) and the first and second edge segment (R1, R2).

5. The exhaust gas system (1) according to claim 1, wherein the first and second edge segments (R1, R2) have a spacing (aR) and the spacing (aR) corresponds to an internal diameter (di2) of the exhaust gas fitting (2.1).

6. The exhaust gas system (1) according to claim 1, wherein the partition wall (3.2) has a width (b2) between 1 mm and 7 mm, at least in the area of the groove (3.3).

7. The exhaust gas system (1) according to claim 1, wherein the exhaust gas pipe fitting (3.1) has a housing wall (3.4) with an inner circumference (Ui3) and in one end face of the housing wall (3.4) an indentation (3.5) with a width (b3) is provided, forming a bearing surface (3.1*a*) and extending in the direction of the flow axis (S2, S3) across the inner circumference (Ui3).

8. The exhaust gas system (1) according to claim 1, wherein the groove base (3.3G) is provided in relation to the flow axis (S2, S3) at least partly at the height of the end surface (3.1*s*) or the bearing surface (3.1*a*).

9. The exhaust gas system (8) according to claim 8, wherein the first and/or second edge segment (R1, R2) and/or the partition wall (2.2) and/or the particular half shell (2*a*, 2*b*) of the exhaust gas fitting (2.1) bears tightly against the bearing surface (3.1*a*) of the exhaust gas pipe fitting (3.1) in a cold state at the end face inside the indentation (3.5) of the exhaust gas pipe fitting (3.1) in the direction of the flow axis (S2, S3).

10. The exhaust gas system (1) according to claim 1, wherein the partition wall (2.2) is fashioned thicker than a width (b) of the groove (3.3), while the partition wall (2.2) in the area of the end surface (2.2*s*, 3.2*s*) has a flattening (2.3) with a thickness (d), and the thickness (d) is either equal to the width b of the groove (3.3) or smaller than the width b of the groove (3.3).

11. The exhaust gas system (1) according to claim 10, wherein the flattening (2.3) has a height (hA) in the direction of the flow axis (S2, S3), while the partition wall (2.2) is inserted into the groove (3.3) by 5% to 70% of the height (hA).

12. The exhaust gas system (1) according to claim 1, wherein the groove base (3.3G) is profiled in the direction of the flow axis (S2, S3) or a geometrical axis (G) and/or its profiling matches the profile of the end surface (2.2*s*).

13. The exhaust gas system (1) according to claim 1, wherein there is provided a spacing a between the groove base (3.3G) and the end surface (2.2*s*) of at least 0.1 mm to 0.3 mm in the radial direction to the flow axis (S2, S3).

14. The exhaust gas system according to claim 12, wherein the flattening (2.3) has a height (hA) in the direction of the flow axis (S2, S3), while the partition wall (2.2) is inserted into the groove (3.3) by 10% to 50% of the height (hA).

15. The exhaust gas system according to claim 11, wherein the flattening (2.3) has a height (hA) in the direction of the flow axis (S2, S3), while the partition wall (2.2) is inserted into the groove (3.3) by 30% of the height (hA).

* * * * *

UNITED STATES PATENT AND TRADEMARK OFFICE

CERTIFICATE OF CORRECTION

PATENT NO. : 9,291,087 B2
APPLICATION NO. : 13/500660
DATED : March 22, 2016
INVENTOR(S) : Markus Geminn et al.

It is certified that error appears in the above-identified patent and that said Letters Patent is hereby corrected as shown below:

Claims

In column 10, claim 4, line 58, please replace "partition wall (22)" with --partition wall (2.2)--

In column 11, claim 9, line 16, please replace "exhaust gas system (8)" with --exhaust gas system (1)--

Signed and Sealed this
Fourteenth Day of June, 2016

Michelle K. Lee

Michelle K. Lee
*Director of the United States Patent and Trademark Office*